United States Patent [19]

Montgomery et al.

[11] Patent Number: 4,702,435

[45] Date of Patent: Oct. 27, 1987

[54] FLIGHT CONTROL APPARATUS

[75] Inventors: William J. Montgomery, Antrim; Eric Nicholson, Bangor, both of Northern Ireland

[73] Assignee: Short Brothers PLC, Belfast, Northern Ireland

[21] Appl. No.: 846,737

[22] Filed: Apr. 1, 1986

[30] Foreign Application Priority Data

Apr. 2, 1985 [GB] United Kingdom ..... 8508641
Feb. 3, 1986 [GB] United Kingdom ..... 8602605

[51] Int. Cl.[4] ..... F41G 7/26
[52] U.S. Cl. ..... 244/3.13
[58] Field of Search ..... 244/3.13

[56] References Cited

U.S. PATENT DOCUMENTS 4,014,482 3/1977 Esker et al. ..... 244/3.13
4,111,384 9/1978 Cooper ..... 244/3.13
4,200,251 4/1980 Borjesson et al. ..... 244/3.13

FOREIGN PATENT DOCUMENTS 0002576 6/1979 European Pat. Off. .
1512405 6/1978 United Kingdom .

*Primary Examiner*—Charles T. Jordan
*Attorney, Agent, or Firm*—Cushman, Darby & Cushman

[57] ABSTRACT

A laser guidance beam (30) for beam-riding aerial missiles is reflected at a stabilized mirror (M) to stabilize its position in space. A target (T) is viewed by an operator in a field of view (22) which also contains an aiming mark (A) stabilized by the mirror (M). A joystick (27) is used to generate signals for rotating the mirror (M) to bring the stabilized aiming mark (A) into superposition with the target, whereby the guidance beam (30) is also superposed on the target. Separate mirrors can be used for stabilization in pitch and yaw (FIG. 8). Different mirror elements on a single mirror unit, with the elements separated by a baffle, can be used to eliminate the risk of laser radiation of the guidance beam from entering the eye of the operator.

14 Claims, 8 Drawing Figures

FLIGHT CONTROL APPARATUS

BACKGROUND OF THE INVENTION

1. Field of the Invention

This invention relates to flight control apparatus for remotely piloting a flight vehicle to a target.

2. Description of Related Art

It has previously been proposed to control the flight of a surface-to-air guided missile by the use of a radio guidance signal transmitted from a flight control apparatus operated by a human operator. The flight control apparatus comprises elements defining an optical path by means of which the operator can see the target and the missile in a field of view and, by means of a joystick control and a radio transmitter, steer the missile within the field of view on to the target also within the field of view.

SUMMARY OF THE INVENTION

It has been found that the demands placed upon the human operator by this prior proposal sometimes exceed the capabilities of the operator, for example, when he is under heavy attack or when visibility is poor. Besides, missile guidance by radio is vulnerable to detection and defensive counter-meaures. It is one object of the present invention to alleviate these disadvantages of the prior proposal.

According to a first aspect of the present invention there is provided a method by which an operator may guide an aerial flight vehicle along a beam to a target comprising the steps of:

(i) generating a guidance beam of radiation carrying information sufficient to identify the positional co-ordinates of points within the beam cross-section relative to the axis of the beam;

(ii) transmitting the beam along an optical path through a stabilised optical aiming device which can be actuated to vary the direction of the beam in space;

(iii) creating a field of view through which the target is viewed by the operator;

(iv) injecting into the field of view an aiming mark, the position of which is representative of the direction of the beam in space; and (v) enabling the operator to actuate the aiming device whereby he may superimpose the aiming mark on the target, with the consequence that the direction of the guidance beam in space is varied so as to guide the vehicle into coincidence with the target.

According to a second aspect of the present invention there is provided apparatus for generating a guidance beam of radiation for guiding an aerial flight vehicle along the beam to a target, the beam carrying information sufficient to identify the positional co-ordinates of points within the beam cross-section relative to the axis of the beam, characterised by (i) a stabilised optical beam aiming device which can be actuated to vary the direction of the guidance beam in space;

(ii) means for an operator to observe the target in a field of view;

(iii) means for injecting into the field of view an aiming mark the position of which is representative of the direction of the guidance beam in space;

(iv) operator-controlled means for actuating the aiming device to superimpose the aiming mark on the target, with the consequence that the direction of the guidance beam in space is varied so as to guide the vehicle into coincidence with the target.

The operator will normally be human in which case the system is one which can be termed "Semi-Automatic Command to Line-of-Sight (SACLOS)". Otherwise, use of an imaging system such as a CCD (charge coupled device) camera or thermal imager and data processing facilities may enable fully automatic acquisition of the target in the field of view, and control of the aiming device. In such a case, the "field of view" into which the aiming mark is injected and the "aiming mark" itself will be represented electronically, and not visible to the human eye.

With the invention, all that is required of the operator is that he keeps the target within the field of view and, within that field of view, brings the aiming mark into timely coincidence with the target. Provided the target can be recognised and the beam can penetrate the atmosphere to the target, low levels of visibility should have no adverse effect on the functioning of the apparatus. The beam which the vehicle detects and along which it rides is less easy to detect and defend against than the prior radio guidance.

The aiming mark being stabilised within the field of view, movements of the flight control apparatus as a whole will not themselves carry the aiming mark away from the desired position. Instead, the position of the aiming mark will remain stable within a moving field of view. When, as normally, the operator is human, movements of the stabilised aiming mark, in pitch and yaw, within the field of view, are effected by a manually-operable tracking means, and this is conveniently provided in the form of a joystick control.

In preferred embodiments of the invention the stabilised optical aiming device is itself used to stabilise the position of the aiming mark on the operator's field of view. Most preferably the optical path is stabilised by inclusion within it of a single optical element which is caused to pivot as required, both in yaw and pitch. One way in which this can be achieved is to mount the optical element in a gimbal, for rotation of the element about an axis within the gimbal, and rotation of the gimbal itself about an axis perpendicular to that on which the optical element rotates in the gimbal.

Conveniently, the optical element is a dichroic mirror, which deflects the aiming mark into the operator's field of view and also allows passage through itself of radiation from the target to the operator's field of view.

Those skilled in the art will be aware of proposals for generation of guidance beams of modulated laser radiation. See for example, those of British Patent Specification No. 1512405, U.S. Pat. Nos. 4,014,482 and 4,111,384 and European Patent Application No. 0002576.

BRIEF DESCRIPTION OF THE DRAWINGS

For a better understanding of the present invention and to show more clearly how the same may be carried into effect, reference will now be made, by way of example, to the accompanying drawings, in which.

DETAILED DESCRIPTION OF PREFERRED EMBODIMENTS

Figure 1:
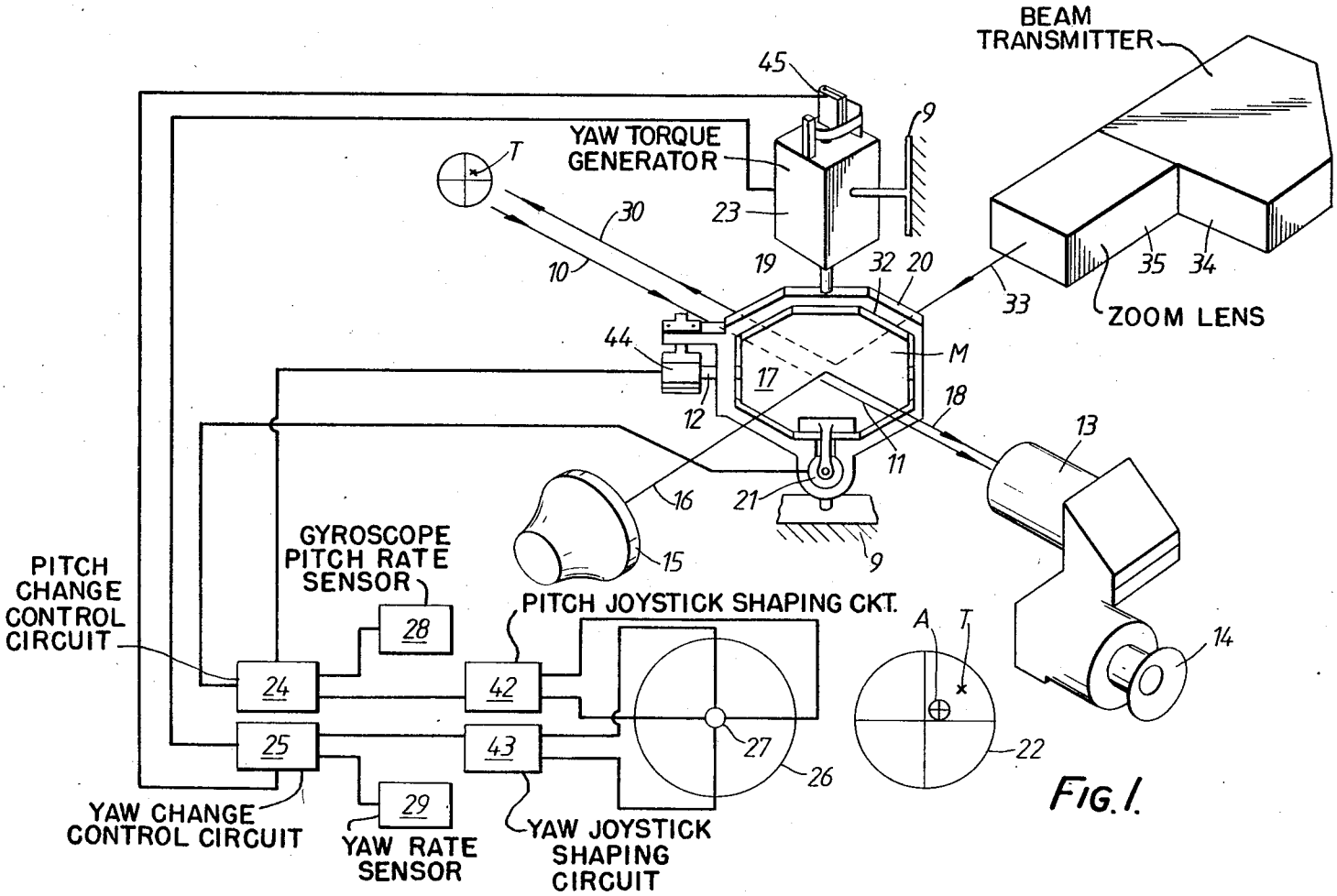
FIG. 1 is a schematic isometric diagram of a preferred embdiment of the invention, and of optical elements along the paths.

Referring first to FIG. 1, radiation 10 from a target T passes along a first optical path 11 through a dichroic mirror M to a monocular sight 13 with an eye piece 14 through which an operator may view the target. The dichroic mirror M is pivotably mounted on a shaft 12 which is itself carried in a gimbal 20. The gimbal 20 is pivotably mounted on a shaft 19, and the axes of both of the shafts 12 and 19 pass through the axis of path 11.

A pitch solenoid actuator 21 carried on the gimbal 20 and with its moving armature coupled to the mirror M can be actuated to cause the mirror M to rotate within the gimbal 20 to any required angle within an angular range of about 5°. A yaw torque generator 23, mounted within the housing 9 of the apparatus and with its shaft coupled to the shaft 19, can be actuated to cause the gimbal 20 to rotate within the housing. The pitch solenoid actuator 21 is positioned such that the axis of the yaw torque generator 23 passes through the center of the solenoid actuator mass 21 thus keeping to a minimum the yaw inertia to which the yaw torque generator 23 is subject.

An aiming mark injector 15 which comprises a lens system with an LED (light emitting diode) array in the focal plane projects a beam 16 of visible light defining an aiming mark A onto the mirror surface 17 of the stabilised mirror M. The resulting stabilised reflected beam 18 enters the monocular sight 13 and eye piece 14 and appears in the operator's field of view 22 seen at the eyepiece 14. Not shown is any filter in front of the sight 13, but it may be desirable in certain circumstances to provide one.

The pitch change actuator 21 is actuated by a pitch change control circuit 24 and the yaw torque generator 23 by a yaw change control circuit 25. The pitch control circuit 24 receives an input signal from a gyroscopic pitch rate sensor 28 and the yaw control circuit 25 from a yaw rate sensor 29, which generate rate signals indicative of movement of the housing of the apparatus in pitch and yaw respectively. The shaft 12 carries a strain gauge pick-off 44 for feeding back pitch position data to the control circuit 24 and the shaft 19 carries a similar pick-off 45 for the control circuit 25. The control circuit 24 delivers a pitch stabilising signal to the solenoid actuator 21 for rotating the shaft 12 such as to stabilise the aiming mark in pitch. Similarly, a yaw stabilising signal is delivered to the yaw torque generator 23 for rotating the shaft 19 such as to stabilise the aiming mark in yaw. Thus, in whatever manner the housing 9 of the flight control apparatus is moved in pitch and yaw, the projected position of the aiming mark in space should remain constant.

In order that the aiming mark may track the position of the target T viewed in the field of view 22, the operator is provided with a joystick tracking means 26 with a thumb-operated joystick 27 for generating rate signals in pitch and yaw which actuate the torque generator 23 and the solenoid actuator 21 appropriate to move the aiming mark within the field of view, as required for tracking the target. The joystick 27 moves the aiming mark A within the field of view 22 in the eyepiece 14 by generating a simple yaw tracking signal and pitch tracking signal. These signals pass to joystick shaping circuitry 42 and 43 which modify the simple joystick outputs in pitch and yaw respectively to optimise tracking accuracy by the use of non-linear shaping and a variable gain profile. The non-linear shaping gives reduced response to small joystick movements in the center of the field of view and the variable gain profile gives a decreasing response to the pitch and yaw joystick demands with increasing time from initiation of tracking, i.e. with increasing range of the missile from the tracking apparatus. Typically the decreasing gain profile ramp is started by a "ramp enable" signal generated a short time, e.g. four seconds, after the commencement of flight of the missile.

A guidance beam 33 of laser radiation (e.g. an x-y scanning beam) is generated in a beam transmitter 34, passes through a zoom lens 35 and is reflected at the surface 32 of the dichroic mirror M. The stabilised reflected beam 30 is projected out from the flight control apparatus towards the target. The guidance beam 33 is coincident with the aiming mark so that, provided the operator is capable of manipulating the joystick 27 to bring the aiming mark A into coincidence with the target T, the reflected guidance beam 30 will be centered on the target T.

Figure 2:
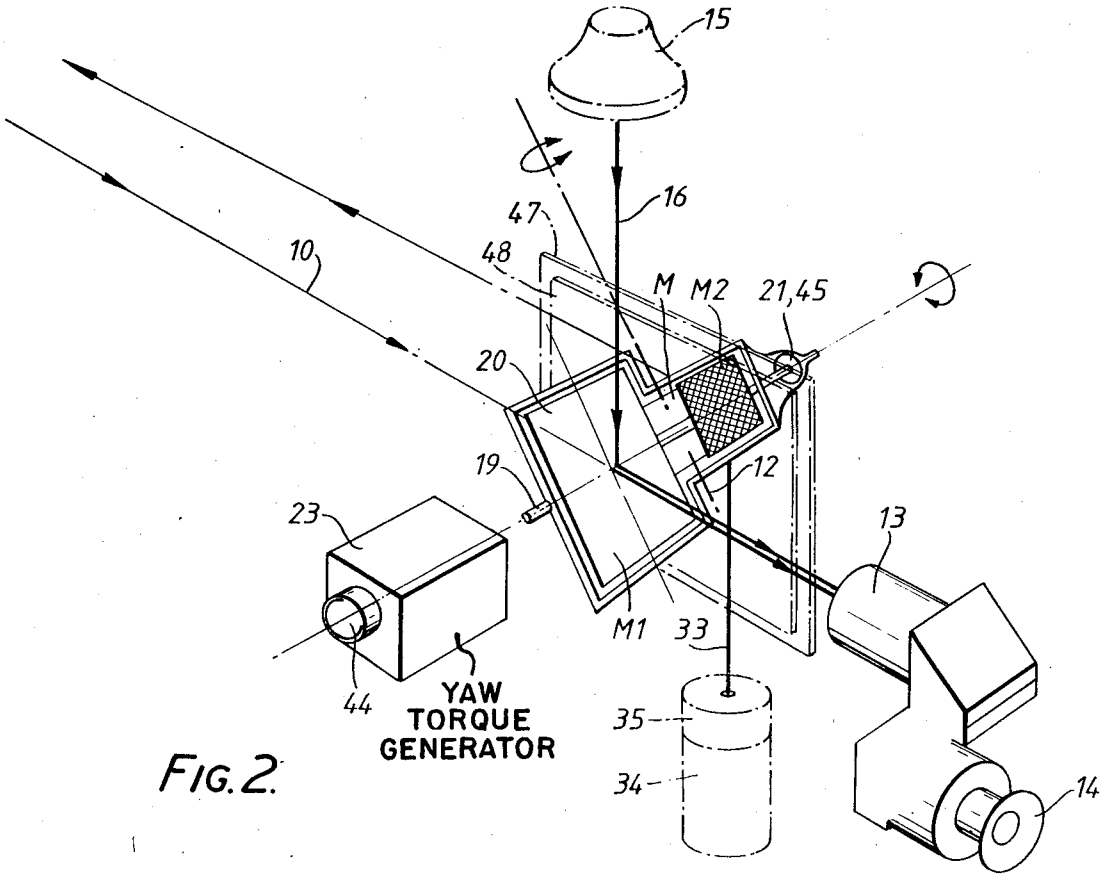
FIG. 2 is a similar diagram of a second embodiment.
Figure 3:
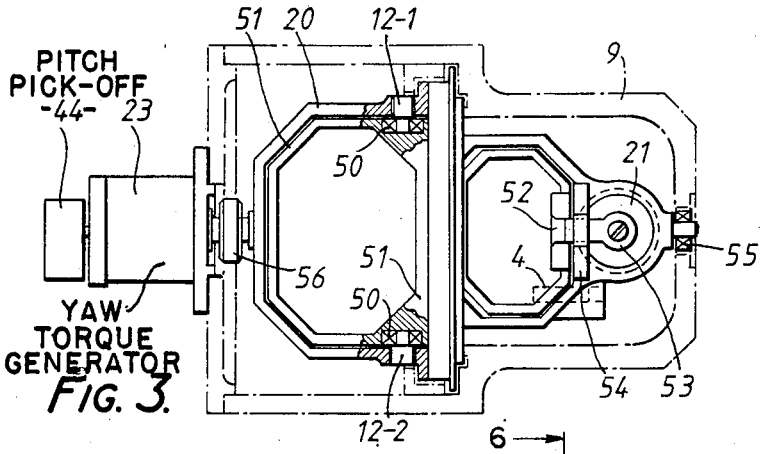
FIG. 3 is a plan view of the mirror assembly shown in FIG. 2, and is shown in section in the area of the mirror pivot bearings.
Figure 5:
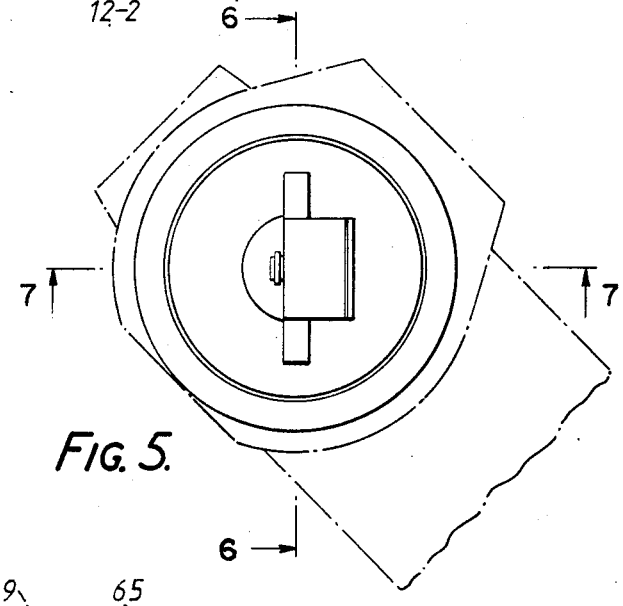
FIG. 5 is an end elevation of the mirror, corresponding to FIG. 3.
Figure 4:
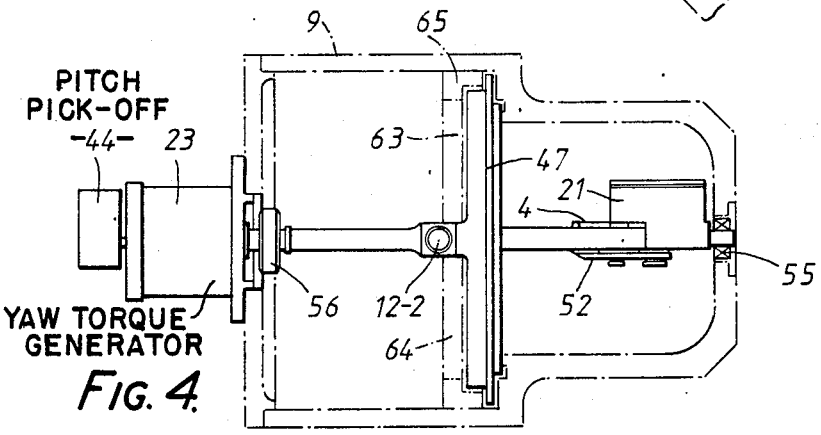
FIG. 4 is a side elevation.

The embodiment of FIG. 2 is similar, and like references are used to identify components which correspond. It should be noted that the gimbal rotates about a horizontal axis 19 for pitch stabilisation, rather than yaw.

The moving mirror unit M within the gimbal 20 comprises a dichroic mirror element M1, and a mirror element M2 which is fully reflective on one side. The unit M pivots about shaft 12 located between the two mirror elements M1 and M2.

The laser source 34 is arranged so that the laser beam 33 is reflected at the mirror M2, whereas the radiation from the target 10, and that 16 from the aiming mark injector 15, is incident on element M1 for onward travel to the eyepiece 14.

The mirror unit M is stabilised and operated by joystick as in FIG. 1. The pick-off 45 for yaw stabilisation is mounted next to the solenoid yaw actuator 21 instead of on the shaft 12.

A pair of generally planar webs (which act as baffles or safety diaphragms) 47 and 48 are provided, for preventing any accidental travel of laser radiation to the mirror element M1 and thence to the eyepiece 14. One web 47 is mounted on the gimbal 20 and the other web 48 on the moving mirror unit M. The plane of each of these webs lies close, and parallel, to the shaft 12, and a reasonable gap is provided between them, so that the mirror M can pivot through at least a limited angle (say, up to 5°) about the shaft 12 without any contact between the two diaphragms. In FIG. 2, the webs are indicated only schematically, and in phantom lines, for the sake of clarity.

FIGS. 3 to 7 show in more detail the construction of the mirror assembly of FIG. 2.

The gimbal 20 carries two stub shafts 12-1 and 12-2, each carried in a bearing 50 in a mirror frame 51. The mirror frame 51 includes an arm 52 itself fixed to the moving armature 53 of the yaw actuator 21. A stop 54 is provided on the gimbal 20 to limit outward travel of the armature. The frame 51 pivots in the gimbal 20. The gimbal 20 is held by a clamp 56 to the shaft of the pitch torque generator 23. The gimbal 20 pivots with the pitch torque generator shaft and is supported by a tail end bearing 55 in the housing 9.

Figure 6:
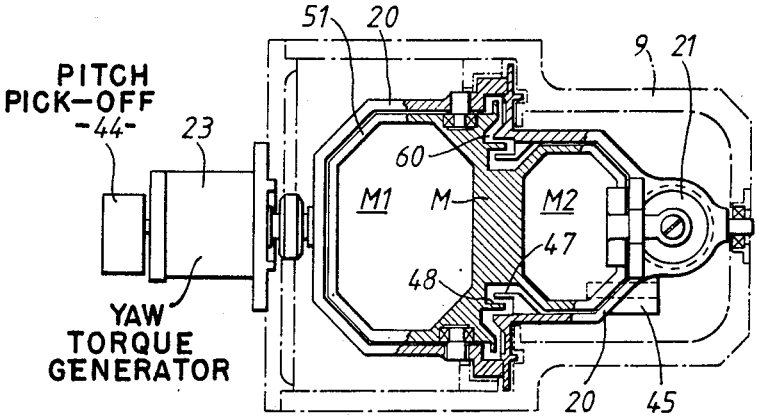
FIG. 6 is a section on 6—6 as indicated in FIG. 5.

FIG. 6 shows the labyrinth gap 60 between the one web 48 of the moving mirror frame 51 and the other web 47 mounted to the gimbal 20. The strain gauge yaw pick-off 45 and pitch pick-off 44 should also be mentioned.

Figure 7:
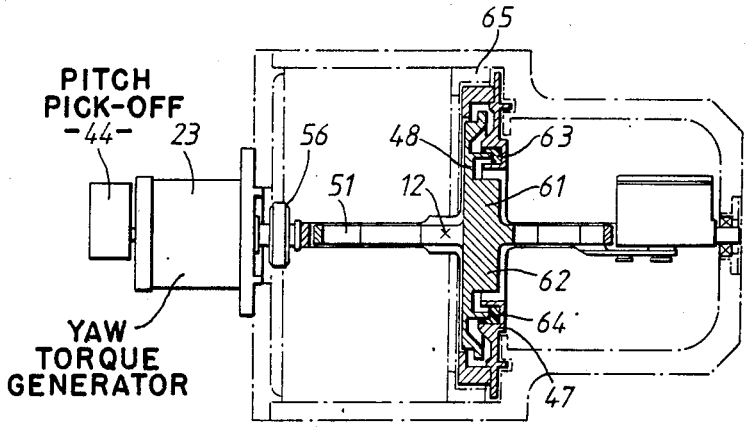
FIG. 7 is a section on 7—7 in FIG. 5.

FIG. 7 shows that the web 48 is formed as a unitary portion of the mirror frame 51, to define wall portions 61 and 62 which extend transverse to the surfaces of the mirrors M1 and M2 near the pivotal axis 12 and terminate in labyrinth seals 63 and 64 with the adjacent annular web 47.

To ensure safety between the mirror frame 51 and the gimbal 20 in the event of a failure occurring at the yaw pivots 12-1 and 12-2, the gimbal 20 is designed in two parts which are located and bolted together such as to trap the mirror unit M between them, to limit its movement to within the normal working range of 5°. The center web or diaphragm 47 of the gimbal 20 is in turn trapped with a limited amount of clearance around it between the housing 9 and a gimbal retaining ring 65.

In the event therefore of a total failure of the pitch 19 and yaw 12 pivots, the complete mirror assembly (20 and M) will still be retained in position, to resist any possibility of passage of laser radiation from the transmitter 34 to the eyepiece 14.

It is to be noted that the embodiment of FIGS. 2 to 7 differs from that of FIG. 1 in that the optical axis of each of the three beams 10,16 and 33 of radiation incident on the moving mirror unit M does not pass through the axis of pivotal movement about the shaft 12. Instead, there is an offset of about 2 or 3 cms. The pivotal movement is, however, small enough for this small offset not adversely to affect the efficiency of stabilisation, especially when it is required for aiming a laser beam onto a target at a distance of, say 2 or 3 kilometers.

Figure 8:
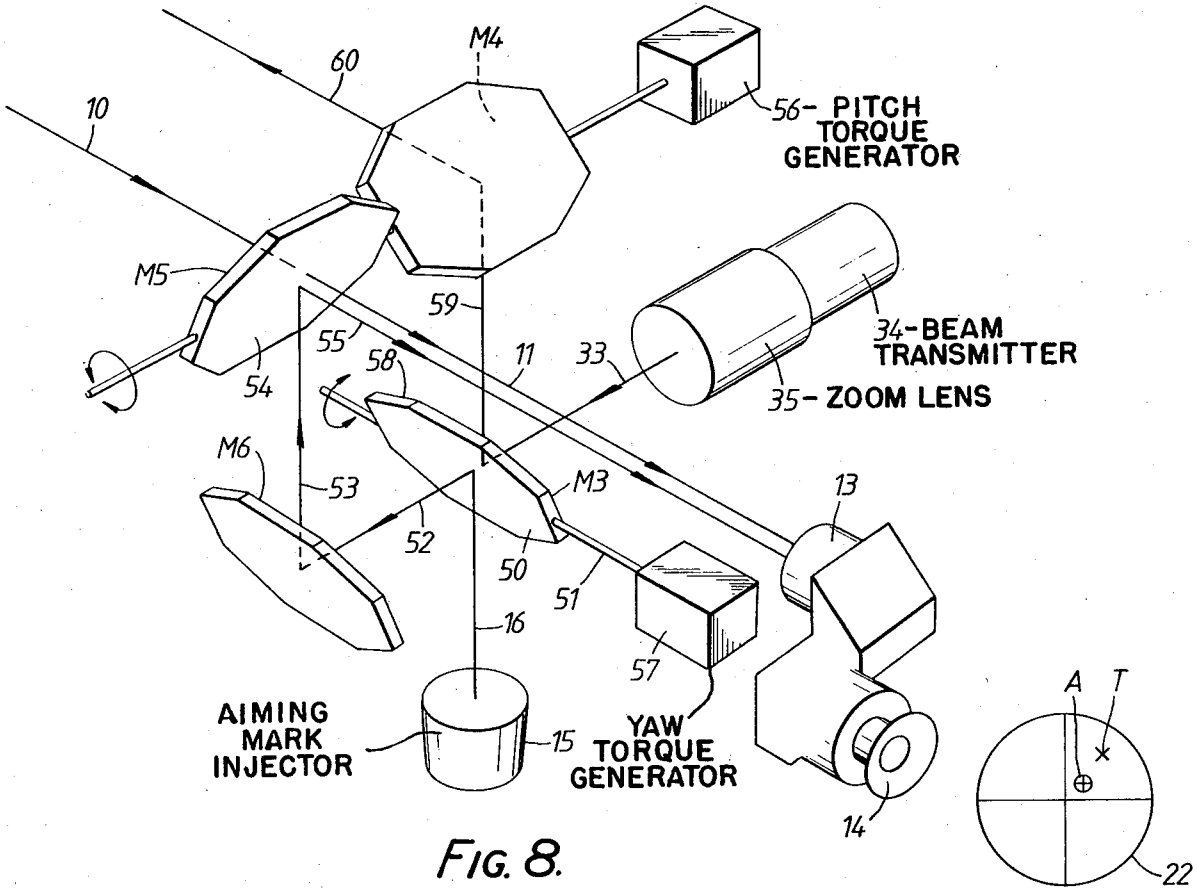
FIG. 8 is a schematic isometric diagram of a third embodiment of the invention.

Referring now to FIG. 8, the embodiment shown is generally similar to that of FIG. 1. For simplicity some common components are not shown. Where possible, the same reference numerals are used.

Radiation 10 from the target T passes along a first optical path 11 through a dichroic mirror M5 pivotably mounted on a shaft 12 which extends through the axis of the path 11, to a monocular sight 13 with an eye-piece 14 through which an operator may view the target.

The beam 16 from the aiming mark injector 15 is reflected at a first surface 50 of a double-sided mirror M3, pivotably mounted on a shaft 51 the axis of which extends through the optical axis of the beam 16.

The reflected beam 52 undergoes reflection at the surface of a fixed mirror M6, and the twice-reflected beam 53 is then reflected at the surface 54 of the dichroic mirror M5, whereby the thrice-reflected beam 55 enters the monocular sight 13 and eye-piece 14.

As in FIG. 1, a pair of gyroscopic rate sensors generate rate signals indicative of movement of the housing in pitch and yaw. The pitch rate signal is delivered to a torque generator 56 for rotating the shaft 12 such as to stabilise the aiming mark in pitch. Similarly, the yaw rate signal is delivered to a yaw torque generator 57 for rotating the shaft 51 such as to stabilise the aiming mark in yaw.

The laser guidance beam 33 is reflected at the surface 58 of the yaw-stabilising mirror M3. The reflected beam 59 undergoes the reflection at a surface of a second pitch-stabilising mirror M4 mounted on the shaft 12. The twice-reflected radiation 60 is then projected out from the flight control apparatus towards the target.

In all embodiments, means (not shown) are preferably included for generating and inputting, respectively and as required, a super elevation offset to the pitch control circuitry 24 and a wind offset to the yaw control circuitry 25. The beam transmitter 34 includes a motorised zoom lens 35, the aiming mark injector 15 can include a variable diameter range ring and the apparatus can include electronics appropriate to control the zoom lens and range ring to make due allowance for the increase with time of the range of the missile under guidance, as it flies away from the control apparatus.

The electronics which control the movement of the aiming mark in the field of view may provide for operator selection of a "rate aided" tracking mode instead of a fully stabilised tracking mode. In the rate aided tracking mode, the aiming mark A, as seen in the aimer's field of view 22, lags the central axis by an amount proportional to the tracking rate, so that the missile will be fired ahead of the target being tracked.

We claim:

1. A method for controlling the flight of an aerial vehicle to a target, comprising the steps of:

providing a field of view to an operator using viewing means provided in a primary optical path, and acquiring said target within said field of view by moving said viewing means;

generating a guidance beam for guiding said vehicle to said target;

stabilizing said beam with a beam stabilizing device by projecting said beam along a secondary optical path stabilized against predetermined movements of said viewing means;

actuating said beam stabilizing means with beam deflection means to vary an angular disposition of said beam in said secondary path with respect to said primary optical path;

injecting an aiming mark into said field of view with aiming mark injection means which are responsive to said actuation of said beam stabilizing means by said beam deflection means, a disposition of said aiming mark being representative of said angular disposition of said guidance beam with respect to said primary optical path; and actuating said beam deflection means with operator-controlled means to bring said guidance beam onto said target by bringing said aiming mark onto said image of said target within said field of view.

2. A method according to claim 1 wherein the guidance beam is a laser beam.

3. A method according to claim 1 further including the step of stabilising the position of the aiming mark in the field of view.

4. A method according to claim 1, further comprising the step of using different optical elements to stabilise the guidance beam in pitch and in yaw respectively.

5. A method according to claim 1 further comprising the step of using a single optical element to stabilise the guidance beam both in pitch and in yaw.

6. Apparatus for controlling the flight of an aerial vehicle to a target, comprising:

viewing means providing a primary optical path by which a field of view is presented to an operator, said viewing means being movable for acquizition of a target within said field of view;

beam generating means for generating a guidance beam for guiding said vehicle to the target;

beam stabilizing means for projecting said beam along a secondary optical path stabilized against predetermined movements of said viewing means;

beam deflection means for actuating said beam stabilizing means to vary an angular disposition of said beam in said secondary path with respect to said primary optical path;

aiming mark injection means responsive to said actuation of said beam stabilizing means by said beam deflection means to inject into said field of view an aiming mark a disposition of which is representative of said angular disposition of said guidance beam with respect to said primary optical path; and operator-controlled means for actuating said beam deflection means to bring said guidance beam onto said target by bringing said aiming mark onto said image of said target within said field of view.

7. Apparatus as claimed in claim 6 wherein the beam generating means is laser beam generating apparatus.

8. Apparatus as claimed in claim 6, further including aiming mark beam generating means for generating an aiming mark beam, and wherein said beam stabilizing means includes a double-sided stabilised mirror unit, at a first side of which the guidance beam is reflected and stabilised, and at a second side of which the aiming mark beam is reflected into the said field of view, and is stabilised.

9. Apparatus as claimed in claim 6 wherein the beam stabilizing means includes first and second optical elements mounted on respective shafts for rotation about two mutually perpendicular axes under control of pitch and yaw stabilizing actuators, and wherein the guidance beam comes successively under the influence of the two optical elements for stabilisation in pitch and yaw by controlled rotation of the two shafts, and wherein the apparatus includes aiming mark beam generating means for generating an aiming mark beam, and wherein the aiming mark beam also comes successively under the influence of the optical elements moving with the said shafts, for stabilisation of the aiming mark and deflection of it into the field of view.

10. Apparatus as claimed in claim 8 wherein the mirror unit allows passage through it of radiation in the primary optical path and also reflects the aiming mark beam into the primary optical path.

11. Apparatus as claimed in claim 8 wherein the mirror unit is rotatably shaft-mounted on a first axis in a gimbal which also carries a first actuator for rotating the mirror unit about the first axis, the gimbal being shaft-mounted in a housing which rotates under the control of a second actuator about a second axis perpendicular to the first, one of the said axes constituting a pitch axis and the other a yaw axis.

12. Apparatus as claimed in claim 11 wherein a center of inertia of said first actuator lies on the said second axis.

13. Apparatus as claimed in claim 11 wherein said mirror unit comprises first and second mirror elements spaced from one another, the first element serving to reflect the aiming mark beam into said primary optical path, and said second element serving to reflect the guidance beam into said secondary optical path, and further comprising a baffle positioned between the first and second mirror elements for preventing radiation of the guidance beam from entering said primary optical path.

14. Apparatus as claimed in claim 13 wherein the baffle comprises a web on the mirror unit and a web on the gimbal, with a labyrinth gap between the said two webs.

* * * * *